United States Patent [19]

Morrison

[11] 4,101,897

[45] Jul. 18, 1978

[54] C.B. RADIO ANTENNA UNIT SYSTEM AND PROCESS

[75] Inventor: Gary Eugene Morrison, Pampa, Tex.

[73] Assignee: John M. Goldesberry, Houston, Tex.; a part interest

[21] Appl. No.: 720,977

[22] Filed: Sep. 7, 1976

[51] Int. Cl.[2] ..... H01Q 1/32

[52] U.S. Cl. ..... 343/715; 343/882; 343/881; 343/749

[58] Field of Search ..... 343/711-715, 343/749, 882, 885, 900

[56] References Cited

U.S. PATENT DOCUMENTS

| | | | |
|---|---|---|---|
| 2,329,200 | 9/1943 | Hefele | 343/882 |
| 3,453,618 | 7/1969 | Ukmar et al. | 343/749 |
| 3,747,086 | 7/1973 | Peterson | 343/787 |

*Primary Examiner*—Alfred E. Smith
*Assistant Examiner*—David K. Moore
*Attorney, Agent, or Firm*—Ely Silverman

[57] ABSTRACT

A dimensionally stable antenna unit is maintained in a stable vertical position during mobile operation of the radio of which the antenna unit is a part and accordingly improves the transmitting as well as receiving characteristics of the overall radio system.

5 Claims, 15 Drawing Figures

FIG.10
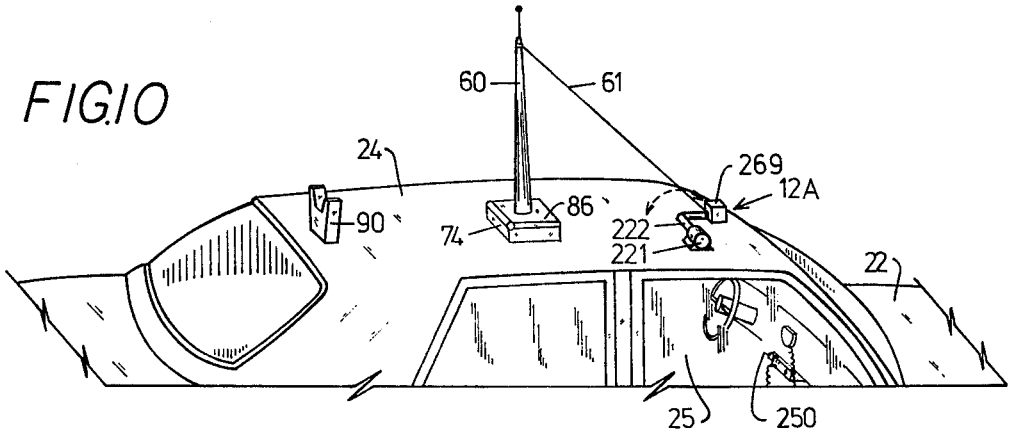
FIG.11
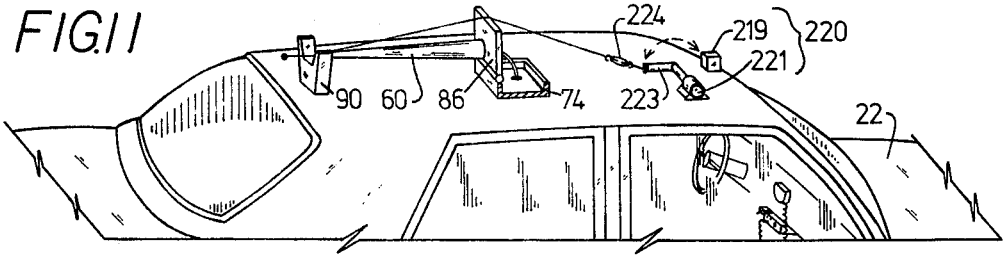
FIG.12
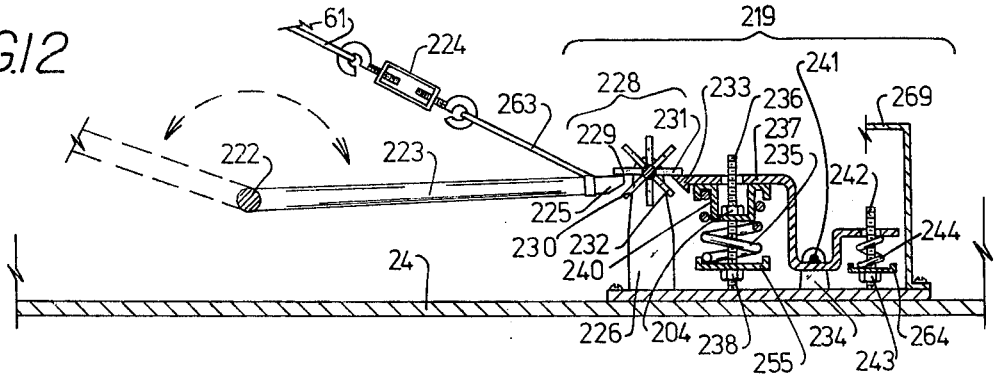
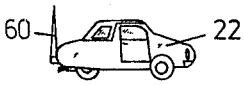
FIG.13
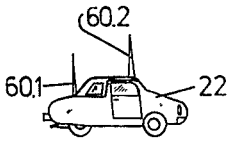
FIG.14

C.B. RADIO ANTENNA UNIT SYSTEM AND PROCESS

BACKGROUND OF THE INVENTION

1. The Field of the Invention

The field of the art to which this invention pertains is radio wave communication and use of antenna with stream-lined shape supports.

2. Description of the Prior Art

The prior art has covered antenna as in U.S. Pat. No. 2,635,186 and 1,962,202 but has not carried such concept of a cover to provide such a degree of support as will provide a mobile C.B. antenna that maintains fixed shape and stable angular orientation with respect to horizontal ground on a moving mobile vehicle. Antenna flexibility has been the goal and as a result during motion the transmission and reception characteristics of C.B. radio system using such antenna has not provided the reception and transmission characteristics of which the 5 watt power permitted for citizen's band radio has been capable.

SUMMARY OF THE INVENTION

By this invention, a practical and efficient broadcast system is provided whereby the transmission and reception characteristics of C.B. radio systems is substantially improved by provided mechanical support to the radiator of the antenna so that the wave pattern produced by such broadcast system is optimized, whereby the full power of the electrical input to the antenna is provided for effective transmission to an audience antenna rather than utilizing only weaker portion of the radiation pattern for such transmission. Further, such maintenance of the orientation and shape of the antenna provides for improved angular relationship of such antenna to the wave front provided by other C.B. broadcasts and a consquent improvement in effective reception of signal met by such antenna and system. The size of non-magnetic support means provided for the electrical antenna structure also permits incorporation of identification and location means to locate and identify stolen antenna units of this type.

BRIEF DESCRIPTION OF THE DRAWINGS

FIGS. 8 and 9 show one car 22 moving in direction 23 on one lane 28 of road 29 while another car 122 moves in lane 128 of road 29 adjacent lane 28 and in direction 123, opposite to direction 23.

FIGS. 10 and 11 illustrate the structure and operation of an alternative embodiment of antenna unit positioner assembly. FIG. 12 is an enlarged view of structures in zone 12A of FIG 10.

FIG. 13 shows one alternative location of the antenna unit 60 on the car bumper.

FIG. 14 shows other alternative locations of an antenna unit as 60—on the trunk lip, at 60.1 and on the rain gutter of the side roof line of car 22 at 60.2.

DESCRIPTION OF THE PREFERRED EMBODIMENT

Figure 1:
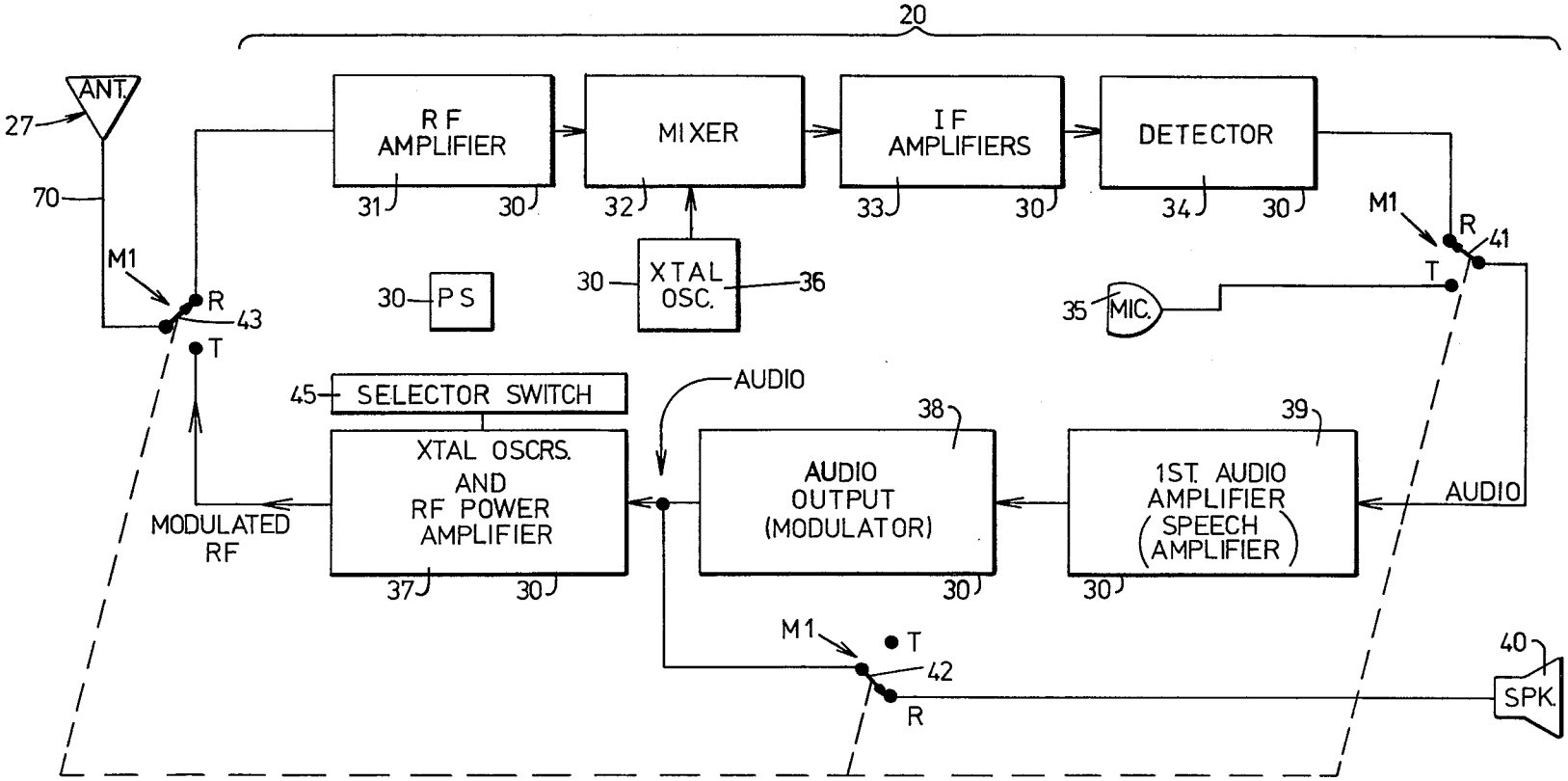
FIG. 1 is a diagrammatic block diagram of a transceiver showing the component units thereof.

A block diagram of a typical CB Class D transceiver 20 utilizing the electrical components 27 of the antenna assembly 60 is provided in FIG. 1 wherein the radio 20 is a combination of transmitter, receiver and power supply components with the transmitter and receiver circuits all contained on the same chassis with the some of the circuits such as the audio output modulator 38 and the audio amplifier 39 used in both circuits. In the transceiver 20 the antenna electrical elements 62 and 66 (shown in FIGS. 5 and 15) feed the radio frequency amplifier, 31; that amplifier, together with the oscillator 36 feeds the mixer and provides signal to the intermediate frequency amplifier 33 and that amplifier transmits audio signal to the detector 34 when in receiver mode; that audio signal is passed by switch 41 to audio amplifier 39 to audio output in modulator 38 and by switch arm 42 to speaker 40. The electrical power source 30 is connected to all these units 31–34, 36, 37, 38 and 39. Units 38 and 39 are used in both transmitting and receiving functions.

The conventional multiple position switch M1 provides for switching the circuits from a receiving mode of operation when its switch arms 41, 42, and 43 are connected to the switch pole referred to as "R" while the same circuits provide, in conventional manner, for transmission of radio signals when the switch arms 41, 42, and 43 of switch M1 are connected to the terminal T therefor.

Unit 20 is a multichannel transceiver provided by selector switch 45 with separate crystal oscillators so that the radio frequency amplifier therefor at 37 may deliver one of several of preselected signals to the electrical components 27 of antenna assembly 60; such unit 20 may be 3 inches high and 8½ inches wide and 8½ inches deep while providing the maximum R.F. input of 5 watts permitted by the Federal Communication Commission. The power to radio 20 is limited by the 5 watt maximum requirement of the Federal Communication Commission to operate in the Class D channel frequencies (26.965 to 27.255 megacycles).

A detailed schematic of such circuit elements of a conventional solid state transceiver is set out on pages 30–31 of "Understanding and Using Citizens Band Radio" published by Allied Radio Shack, January, 1971, Library of Congress Catalog Card Number: 67-18973.

The antenna unit 60 comprises a straight thin conductive element 62 and a rigid plastic shell 64 as well as a loading coil or loader 66; the antenna unit 60 is firmly held by a rigid plate 68 to a support therefor on the roof 24 of the car 22 and a coaxial cable 70 extends from the loader 66 to the transceiver 20.

Figure 5:
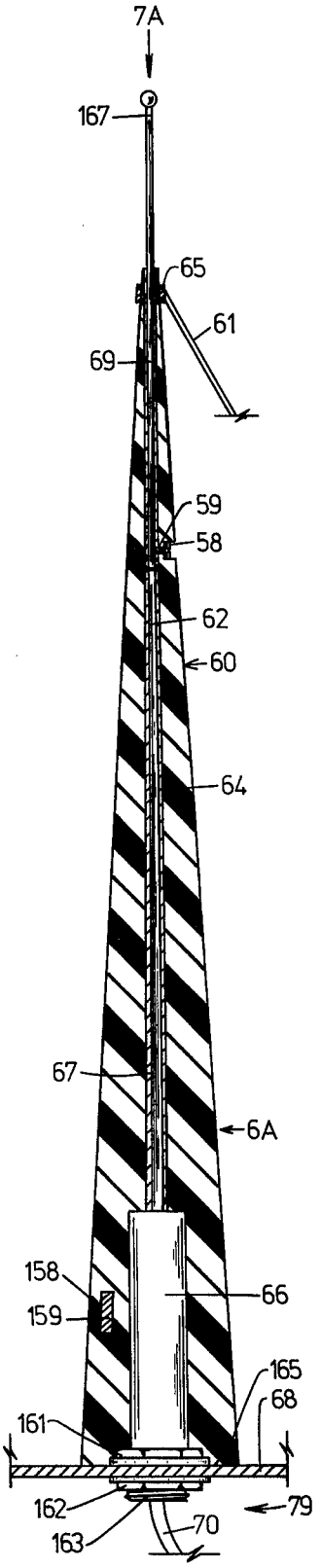
FIG. 5 is a vertical longitudinal section of the antenna along the plane 5A—5A of FIG. 6.
Figure 6:
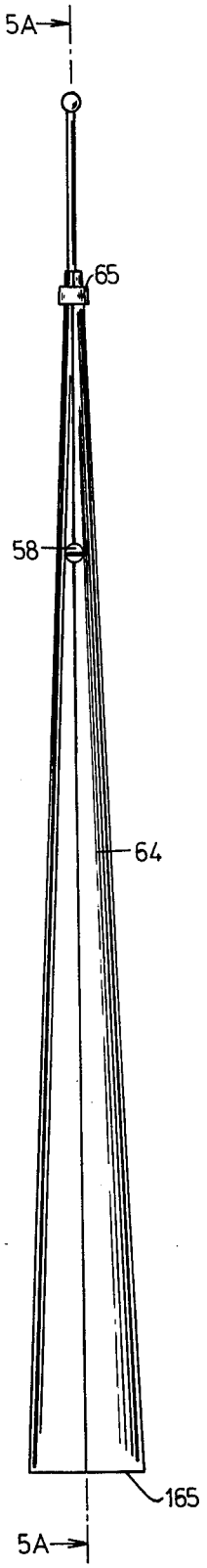
FIG. 6 is a front view of the antenna of FIG. 5 as seen along the direction of the arrow of 6A of FIG. 5.
Figure 7:
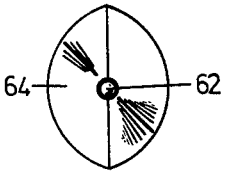
FIG. 7 is a top or plan view along the direction of arrow 7A of FIG. 5.
Figure 8:
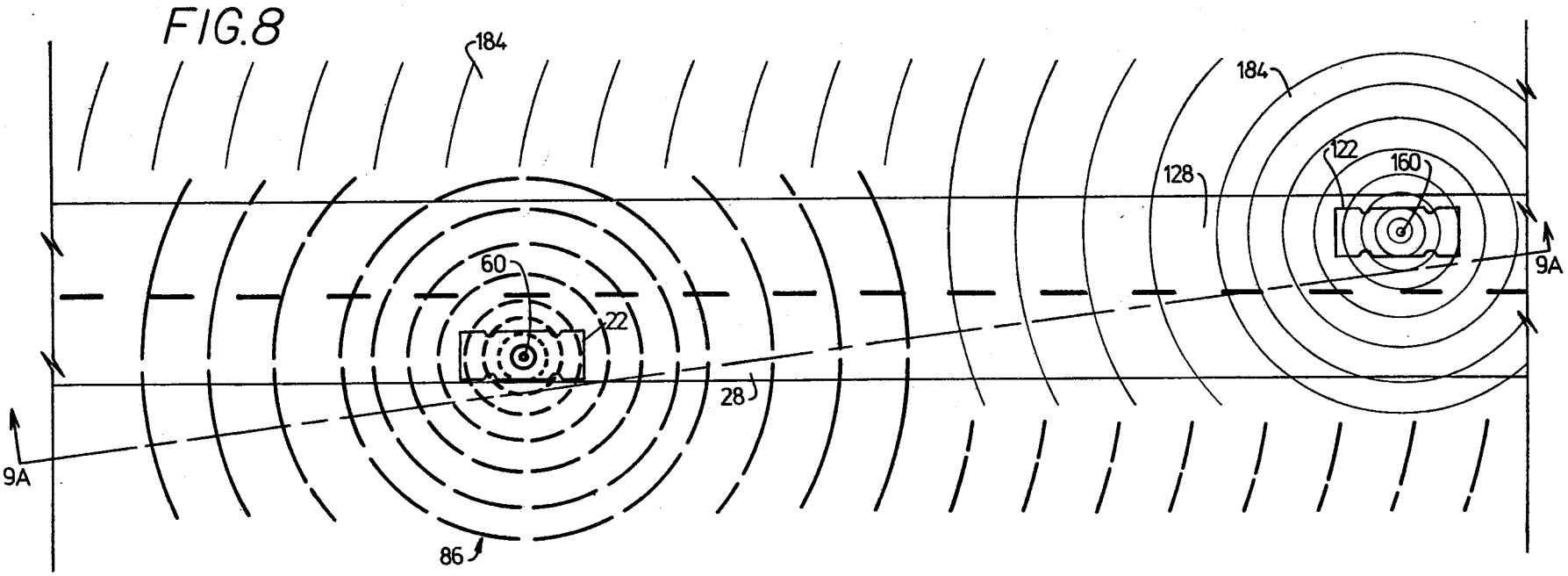
FIG. 8 is a diagrammatic plan view of a stage of the operation of the system of the antenna unit and CB radio of FIGS. 1–7.

In an early embodiment, the antenna unit or assembly 60 shown in FIGS. 5 - 7 had an overall length of 36 inches with an overall maximum width (left to right in FIGS. 6 and 7) of 2 inches and an overall maximum thickness (top to bottom of FIG. 7 and left to right of FIG. 5) of 4 inches; however, a 39 inch high base loaded antenna as unit 42 R-01208 WV as shown at page 216 of Lafayette catalogue 760 (of Layfayette Radio Electronics Corp., 111 Jericho Turnpike, Long Island, New York, 1976) may form the antenna element 62 and loading coil 66 and is firmly supported in a rigid plastic body as 64 as shown in FIG. 5 with a maximum of four inches of antenna wire 62 extending from the top of the rigid plastic body or shell 64; shell 64 tapers from the wide bottom at the bottom face 165 thereof to the top of the triangular shell 64. The plastic shell or cover is a strong plastic as polyethylene and is firmly attached to the surface of the antenna wire 62 and the loading coil 66 and so avoids any movement of the antenna wire 62 with respect to the loading coil 66. Further, the loading coil, as shown in FIG. 5, is firmly attached to the support therefor that is attached to the car, such as plate 68 in FIG. 2 or the bumper in FIG. 13 or the trunk deck. Such attachment to plate 68 may be by rigid nuts 161 and 162 firmly fixed to a rigid threaded hollow shaft 163 and to the plate 68. The bottom face 165 of the mass of plastic body 64 is firmly pressed against and attached to the top surface of the plate 68 and accordingly provides a rigid dimensionally stable support structure for the antenna unit 60. Antenna unit 60 always operates as a quarter wave antenna and may have a height of 72 inches with a loader coil compensating for any excess capacitance of the antenna. In the overall, the firm weather-proof plastic plastic body 64 may be made of a high strength vinyl or polyethylene plastic or other weather-proof material and has sufficient size as 4 to 12 inches width and 2 to 4 inches thickness to limit the oscillation of the topmost portion 167 of the antenna unit 60 to a movement in the longitudinal plane (the plane parallel to that shown in FIG. 5) of less than one inch at the antenna top of the unit 60 when it is six feet long and less than ½ inch in a 3 foot length of the antenna unit 60 at a velocity of 40 miles per hour of car 22.

The mass of electrically nonconductive material forming shell 64 is sufficiently large that magnetically identifiable indicia such as a number bearing plate 159 may be located in that mass and may be identified by conventional magnetic readout means held at the surface of shell 64. Numbers formed of magnetically identifiable ink as used in bank checks may be located within the mass of shell 64 and covered by opaque paint on the surface, as 158, of mass of shell 64 which mass is nonconductive electrically and non-magnetic, or the outer surface of the mass of shell 64, as at 158, adjacent the magnetic indicia as 159 may be so roughened that structures on a small plate or identifying indicia as magnetic numbers are not visible to the human eye from the outside of the plastic mass of shell 64. The magnetic indicia are located below the vertical level of the antenna conductor 62 to avoid or minimize interference with the electromagnetic radiation passing thereto and therefrom. The electrically conductive antenna element 62 is an extensible antenna. It is formed of a bottom larger hollow rigid steel tube 67 of about ⅛ inch internal diameter firmly electrically and mechanically attached by threaded connection to the top of the upper cylindrical tubular portion 69 that is electrically conductive and formed of steel (and may be chrome plated) and has a smooth slidable fit in tube 67. An adjustable threaded set screw 58 is located in a threaded hole 59 therefor in the mass of shell 64 and the tube 67 and locks the movable portion 69 relative to the fixed portion 67. Screw 58 is made of plastic or other non-magnetic material to not interfere with the radio waves to and from antenna unit 60.

Figure 2:
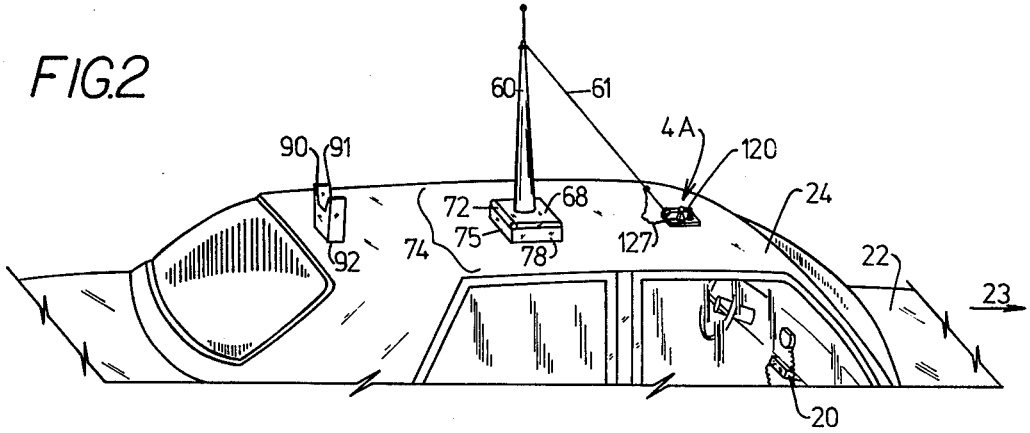
FIG. 2 is a side view of one embodiment of the antenna unit and positioner assembly in its operative antenna position.
Figure 3:
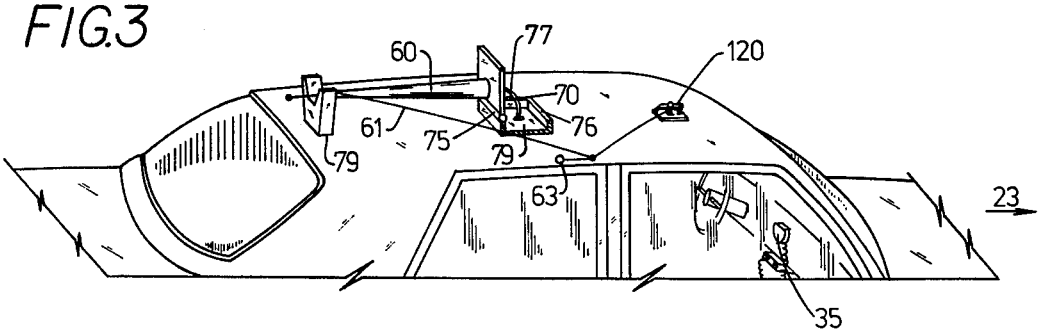
FIG. 3 is a top oblique view of the antenna of FIG. 2 and antenna positioner assembly in the retracted position of the antenna.
Figure 4:
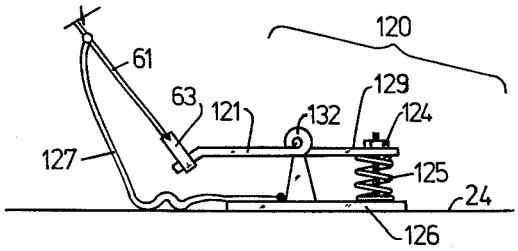
FIG. 4 is a detail in zone 4A of FIG. 2.

In the embodiment of FIGS. 2–4, the unit 60 is firmly attached onto a rigid plate 86. A pivotal piano hinge 72 is firmly attached to plate 68 and to a rigid base 74. The base 74 comprises a rear wall 75, a front wall 76, a left wall 77, and a right wall 78. Each of the walls 75–78 is rigid and vertical and firmly attached to car roof 24 and form a cable receiving chamber 79 therebetween and, together, firmly support plate 86 and unit 60 in the positions of such parts shown in FIG. 2. The coaxial cable 70 passes through a hole at the bottom of the chamber 79 in roof 24 to the loader coil 66.

A rigid antenna receiver 90 which has an upwardly open V-shaped notch 91 formed of soft rubber at its top is fastened at its bottom 92 to the roof 24 of the car. In the raised position of the antenna unit 60 as shown in FIG. 2, a non-conductive strong waterproof nylon string cable 61 firmly attaches to a non-magnetic and electrically cable-holding overload release assembly 120 fixed to car roof 24 and holds the unit 60 in vertical position.

The cable holding assembly 120 comprises a rigid arm 121 which is pivotally supported on a T-shape base 126 fixed to roof 24. A loop on the arm 121 is attached on to a pin 132 on base 126 about which pin arm 121 pivots. The control portion 129 (right side in FIG. 4) of the arm 121 is held downward by an adjustment nut 124 on a threaded rigid shaft therefor (fixed at its bottom to roof 24) against a resilient compression spring 125 to provide adjustment of the tension with which the loop end of arm 121 (left hand end of the arm 121 as shown in FIG. 4) engages a loop 63 at the bottom end of the cable 61. A flexible non-conductive weatherproof safety rope 127 is attached to the cable 61 near the loop 63. In the operative position of antenna unit 60 as shown in FIG. 2, the safety rope 127 is loose and is also attached at one end to the base 126. On attainment of a predetermined maximum tension in cable 61, which maximum tension may be set by the nut 124, the cable 61 raises the arm 121 and disengages therefrom and provides for pivotal release of the antenna unit 60 from its erect position shown in FIG. 2 to the retracted position thereof shown in FIG. 3 by the force theretofore applied to the cable 61. Accordingly, the rigid structure of the antenna unit 60 which provides for its maintained shape and angular orientation is not a cause of any damage thereto by meeting of obstruction such as trees or garage door, inasmuch as a predetermined stress along the cable 61 provides for release of unit 60 although during operation as in FIG. 2 the rigid antenna unit 60 maintains its straight shape and a fixed angular orientation with respect to the vehicle on which supported while in 10–55 m.p.h. motion.

After the antenna unit 60 is in its retracted position on receiver 90 as in FIG. 3 the safety cable 127 serves to connect the cable 61 to the holding assembly 120 and permits an operator to locate and move the loop 63 from its release position shown in FIG. 3 to the operative position thereof as shown in FIGS. 4 and 2 and return the antenna unit 60 to its position of FIG. 2.

Cable 61 holds it in such a position until an overload condition again occurs or the operator chooses to retract the antenna unit 60.

Figure 9:
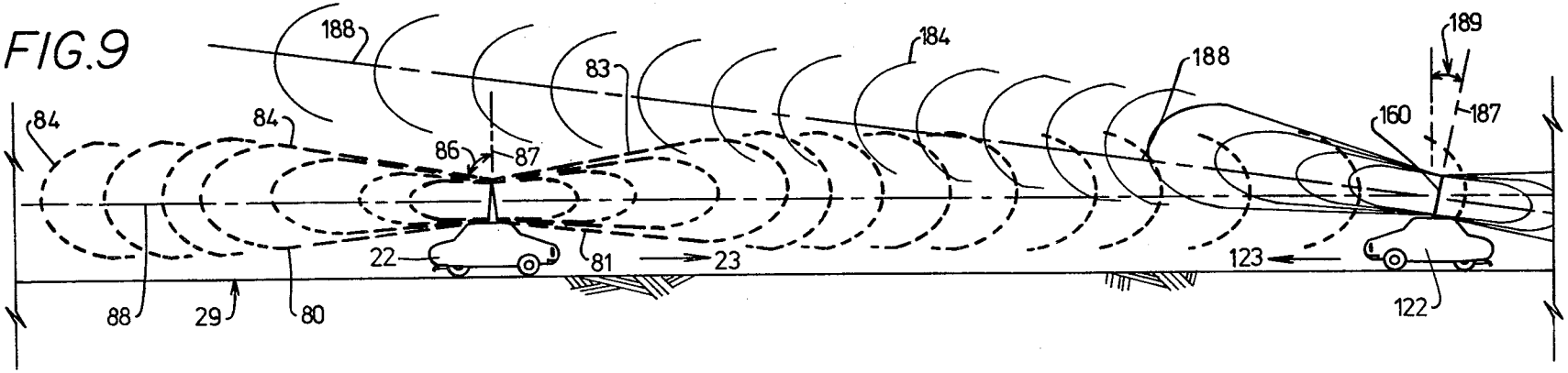
FIG. 9 is a diagrammatic vertical sectional view along the vertical plane 9A—9A of FIG. 8.

With the high frequencies used in Class D operation, antenna unit 60 provides an angle of radiation which is quite low and at these frequencies the radio energy traveling outward as a sky wave is dissipated with a coaxial type quarter wave vertical antenna of which that shown in FIG. 5 is typical. As shown in FIG. 9, the radiation pattern 84 for the R. F. wave emanated by antenna unit 60 is radially downwards at its bottom as at portions 80 and 81 of the pattern 84 and, at the top thereof is a very flat or wide cone having a very wide angle 86 along the axis 87 of the antenna wire of antenna unit on the vehicle 22.

Such radiation pattern 84 is arranged symmetrically about the axis 87 and provides a central pattern plane 88 of maximum field strength passing through the center of pattern 84 which plane 88 is parallel to the rod 29 when the central axis 87 of the antenna wire 62 is vertical. However, when the axis of a conventional C.B. antenna as axis 187 of a conventional whip antenna 160 is used on a vehicle 122 traveling in direction 123 so that the plane 188 (corresponding to the central plane 88) of the radiation pattern 184 emanating from the antenna 160 on vehicle 122 is viewed as in FIG. 9 against the horizontal plane of the road 29 its central plane of maximum field strength 188 (developed by circuit elements identical to those in assembly 20 except for the antenna unit 60) does not meet the vehicle as 22 traveling in a direction 23 along lane 28 of road 29 opposite to the direction 123 of vehicle 122 at distances of 1 to 5 miles between such vehicles as diagrammatically shown in FIG. 9. Antenna unit 60 avoids the tilting and bending of the conventional antenna when such antenna are in operation on a moving vehicle; at 20 m.p.h. the conventional 102–108 inch long antenna bends 4–6 inches at its top, at 40 m.p.h. it bends 9–12 inches and at 70 m.p.h. from 18–24 inches; tilting also occurs.

Even the conventional 39 inch antenna with a loading coil provides a deflection of 4 to 6 inches at its top at a vehicle speed of 40 m.p.h. and readily vibrates 2 to 3 inches at the top. Accordingly, the antenna 20 in moving vehicle 22 carrying an antenna unit as 60 with the vertical axis 87 of antenna wire 62 maintained vertical, has a greater effective field strength than does a moving vehicle as 122 carrying an antenna as 160 with its vertical axis 187 tilted backward by the air traversed by moving vehicle 122 at an angle 189 from the vertical.

In the conventional basic mixer oscillator circuit shown in FIG. 12 for the receiving circuit, the split tuning capacitors 101 and 102 simultaneously tune the input-mixer unit 103 and the local ocillator tank circuit as 104. The radio frequency input signal from the antenna portion 27 is applied to the base of the mixer transistor 105 and the local oscillator signal is applied to the emitter 106. (This provides a certain amount of isolation between the local oscillator 104 and the input signal from the electrical antenna elements 27.) The collector of the mixer transistor 107 is connected to the primary of an intermediate frequency transformer 108 which is in parallel with a capacitor 108. This primary coil 108 and a capacitator 109 form a 455 kHz resonant circuit. The intermediate frequency which is taken off at the output 110 is accordingly directly proportional to the input energy from the electrical antenna elements 62 and 66.

The mixer input circuit selects the desired input signal from the large number of signals present at the antenna and feeds it at 103 to the r-f signal input of the mixer stage. The tuning capacitator tunes the local oscillator and the tuning capacitator and oscillator and mixer coils are so designed the local oscillator is always tuned 455 kHz higher than the mixer input circuit whereby there is always a 455 kHz frequency difference between the local oscillator and the incoming signal. The local oscillator signal at 113 is fed to the oscillator input of the mixer stage; the mixer combines the r-f input and local oscillator and generates two new frequencies, i.e., one being the sum and the other being the difference of the two input signals, whereby a 455 kHz beat frequency is produced and amplified in the intermediate frequency amplifier. While an automatic volume control circuit is standard in radio sets, this only provides for a reduction of the input to the intermediate frequency bias network. A converter may be used in the place of a separate mixer and oscillator. The intermediate frequency output at 110 (in 33) is directly controlled by the input from the antenna electrical elements 27 and, where the axis 87 of the antenna is at an angle to the vertical and hence receives only a component less than the maximum field intensity such angular deviation from the vertical reduces the reception characteristic as well as the transmission efficiency of such antenna as above described. The apparatus 60 of this invention avoids such weakening effect on reception as well as transmission by maintaining the antenna in a continued stable vertical position and shape.

Figure 15:
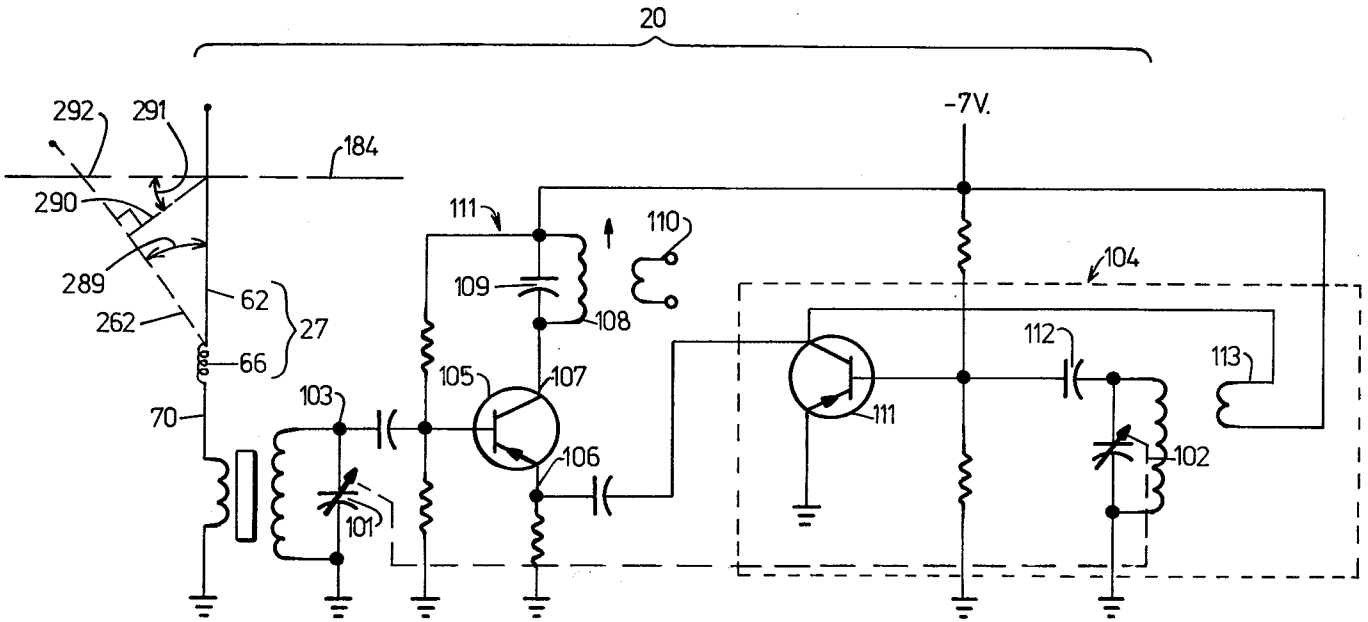
FIG. 15 is a diagrammatic showing of circuit the receiving circuit in assembly 20 compared with relations of some of the structural elements in a conventional circuit.

The improvement of receiving sensitivity of the antenna 60 over the conventional antenna 160 is shown in FIG. 15 and measured by that the waves of radiation pattern 184 striking the vertical element 62 of antenna 60 are at right angles thereto and accordingly are fully effective because of the total structure of antenna assembly 60 to produce electric oscillations in that conductor, while, if such conductor 62 were sloped, as shown for a hypothetical portion 262, at an angle 289 (same as 189) of the total wave energy passing in direction 292 only the portion 290 perpendicular to the direction of that sloped or tilted portion 262 (sloped like axis 187 of antenna 160) and at an angle 291 to the direction 292 would be effective to generate a response in i.f. coil 110 to the total intensity 292 of the radio wave signal passing in direction 292. The vector portion 290 is that fraction of vector portion 292 which equals the cosine of angle 291, and angles 291 and 289 are equal.

Accordingly, the vertical antenna unit 60 more effectively intersects the radio wave electromagnetic field applied thereto along a plane parallel to the road or ground as 29 than does a conventional flexible antenna as 160 which in operation on a moving vehicle is bent at an angle 189 to the vertical as such bent antenna 160 receives only a component which is expressed by the formula:

$$F_{eff} = F_{max} \times \cos \text{angle } 189$$

where:

$F_{eff}$ = effective portion of field meeting antenna and $F_{max}$ = radio wave field intensity at the intersection with the location of the antenna.

In the embodiment of FIGS. 10 and 11 the unit 60 is firmly attached onto a rigid plate 68 and the pivotal piano hinge 72 of which the pivotal axis extends transverse to length of car and direction of extension of antenna unit 60, is firmly attached to plate 68 and to a rigid base 74 as in FIGS. 2 and 3 and the same antenna receiver 90 is used as in FIGS. 2 and 3 and a remote control antenna unit positioner assembly 220 is provided. In the raised position of the antenna unit 60 as shown in FIG. 10 the non-conductive strong weatherproof nylon string cable 61 firmly attaches to a cable-holding and overload release assembly 219 fixed to car roof 24, like the overload release assembly 120 of FIGS. 2 and 4 in front of the antenna base 74. Assembly 219 holds the unit 60 in vertical position to the position of parts shown in FIG. 10.

A remote control antenna unit position control assembly 220 comprises a motor 221 and a cable holding and overload release assembly 219. The motor 221 is connected to and is powered by the battery of car 22 through a switch 250 therefor in cab 25 of vehicle 22. Motor 221 is attached to and drives a rigid L-shaped crank 222 with a rigid longitudinally extending arm 223. Actuation of motor 221 causes arm 223 to rotate from its counter clockwise position shown in FIG. 11 to its clockwise position shown in FIG. 10 while vehicle 22 is stationary or moving. The outer end 225 of the rigid arm 223 is attached to cable portion 263 which is non-extensible and attached to one end of a turnbuckle tightener 224. The other end of the tightener is attached to the cable 61 which is attached to the antenna unit 60 shell 64 near the upper end thereof at collar 65 as shown in FIGS. 2, 5 and 10.

The outer tip 225 of the arm 223 in the position of FIG. 10 contacts one of the arms as 229 of an 8-arm star wheel 228 which is rotatably supported on a first pair of pedestal bases 226 (only one is shown). A rigid control arm 237 is pivotally supported on a horizontally extending pin 241 which pin is supported on a second pedestal 234 which is firmly attached to car roof 24.

In assembly 219, vertical rigid threaded spring adjustment shafts 242 and 236 extend through loosely fitting holes therefor in rigid pawl positioning arm 237. A light tongue positioning compression spring 244 is held in vertically adjustable position loosely on shaft 242 by an adjustable positioning nut 243 therefor which is threaded on the shaft 242 therebelow. The bottom of shaft 242 is firmly held on roof 24. A strong compression spring 235 holds upwardly and rearwardly sloped pawl tongue portion 233 of arm 237 against a forwardly extending star wheel arm 231 (in position of parts of FIG. 10). A spring positioner shaft 236 is firmly held at its bottom on surface of roof 24. Spring 235 is positioned on shaft 236. The force in spring 235 is adjusted by nut 238 on shaft 236.

Accordingly, when the switch 250 (for and connected to motor 221) in the cab of the car 22 is connected, it moves the arm 223 clockwise from its position in FIG. 11 to position thereof as shown in FIG. 10 and thereby raises the antenna unit 60 to operative position. The tip 225 of the arm 223 then strikes and moves one of the rearwardly extending arms 230 of the star wheel 228 from an initial position thereof—the position shown for arm 229 in FIG. 12—to the position thereof shown in FIG. 12 for arm 230.

In the position of parts shown in FIG. 10, the tongue end 233 of arm 237 contacts the bottom of one of the star wheel arms as 231 and prevents the star wheel from rotating and end 225 of arm 223 from rising until a predetermined tension in cable 61 is reached. Until such amount of tension in cable 61 is reached, the star wheel 228 is held from sufficient rotation to release arm 223 and an arm thereof, as 229, holds the arm 223 in a lowered (rightward) position as shown in FIG. 12, and the antenna unit 60 in erect position as shown in FIG. 10.

Assembly 219 thus adjustably provides for release of cable 61 when needed, whereupon (after release) the unit 60 moves to the position thereof shown in FIG. 11. A light spring 244 and the nut 243 on adjustment shaft 242 holds the control arm 237 in position for the movable contact with the star wheel arms as 232 during counterclockwise rotation of the star wheel 228.

The positioner assembly 220 provides that the antenna unit 60 is restored to its vertical position as in FIG. 10 from its position in FIG. 11 while the vehicle is moving or stationary. Spring 235 is provided with a rigid internal restrainer plate 240 (itself movable on shaft 236) to limit the initial vertical length of spring 235 prior to the application of force thereto by arms 223 and 237 so that the change of spring length will be sharper with change of force in cable 61. The spring 235 may, like pedestal 226, be one of pair with a harness therebetween engaging the arm 237. Restrainer plate 240 is positioned by its adjustment nut 204 on shaft 236.

The assembly 219 thus provides a longitudinally and vertically movable pawl (tongue 233) cooperatively connected to resilient means (spring 244) restraining longitudinal movement of the pawl (out of path of arms of star wheel its counterclockwise motion) and adjustable resilient means (spring 235) limiting vertical movement of the pawl (tongue 233) for release of arm 223 when a predetermined stress on line 61 is reached.

The length of antenna cords 61 and 263 and 127 provided for horizontal positioning and full rearward extension of unit 60 from hinge 72 as shown in FIGS. 3 and 11 and holding the portion of antenna unit 60 distant from hinge 72 by the notch in antenna receiver 90 as shown in FIGS. 3 and 11 without breaking such cords. Each of tensile stress supporting cords 61 (and 61 + 263) is taut in the position thereof shown in FIGS. 2 (and 10, respectively) to assist in holding the antenna unit 60 vertical.

In a particular embodiment for a 40 inch distance from plate 86 to the attachment of cord 61 to unit 60 as shown in FIGS. 2 and 10, the rear edge of arms—which are 2 inch radius—of star wheel 228 would be 30 inches forward of hinge 72, and the loop engaging arm 121 is the same distance from hinge 72. Receiver 90 is 30 inches rearward of hinge 72; arm 223 is 13 inches long. Loop rope 127 is 28 to 30 inches long. Receiver 90 is 6 inches wide, high and thick, and the notch therein is 4 inches wide at its top and 5 inches deep, and straight sided and lined with ½ inch thick foam rubber all along the sides of the notch.

The upper portions of the notch sides serve as a guide for the antenna unit 60 and the lower side portions of the notch fit and hold the sides of the outwardly convex faired or curved shape of the unit 60 in the position of parts shown in FIGS. 3 and 11 with a space about ½ inch between the then bottom or rear edge of unit 60 and the bottom of the notch.

As shown in FIG. 1, when switch M1 is in transmission mode, microphone 35 is operatively connected, as by an amplifier as 39, a modulator as 38 and power amplifier as 37 to the electrical portion 27 (comprising radiator 62 and coil 66) of the antenna unit 60.

Plate 255 is provided to hold spring 35 on nut 238; plate 264 holds spring 244 on nut 243; a cover 269 closed at its front end covers the mechanical components of release assembly 219.

I claim:

1. In the combination of a vehicle and a radio frequency communication means in said vehicle and an antenna connected thereto, said antenna on said vehicle, the improvement which comprises a rigid dimensionally stable antenna unit, a pivotal antenna unit support means, a dimensionally stable tension bearing support and an overload release means in operative combination;

(a) said rigid dimensionally stable antenna unit comprising a vertical rectilinear electrically conductive antenna element and a co-axially extending loading coil operatively connected thereto and having a physical height in range of 36 to 72 inches and an electrical characteristic of resonating as a ¼ wave length antenna to a radio broadcast wave length in the 11 meter band of class D citizens band frequencies, and cable connecting means connected to said coil, and a rigid non-magnetic electrically non-conductive shell firmly attached to and surrounding said electrically conductive antenna element and loading coil, forming a rigid dimensionally stable support for said electrically conductive antenna element, said shell extending from the bottom of said antenna unit for the major portion of said antenna unit, the rigidity of said antenna unit being such that said unit does not deflect at its top more than one inch in six feet of length in an air stream passing transverse thereto having a velocity of 40 miles per hour, (b) said pivotal antenna unit support means comprising a rigid plate firmly attached to the bottom of said antenna unit support on said vehicle, a pivotal connection between said rigid plate and said antenna unit support on said vehicle, said pivotal connection extending along an axis transverse to said electrically conductive antenna element and located to the rear thereof;

(c) one, upper, end of a non-magnetic electrically non-conductive dimensionally stable tension bearing support attached to the antenna unit at a portion of the shell thereof near the top of said electrically conductive antenna element and the other, lower, end of said tension bearing support releasably attached to said overload release means, said tension bearing support means extending forward and downward from said one, upper, end to said other, lower, end and latch engaging means at said other, lower, end of said tension bearing means;

(d) said overload release means attached to said vehicle in front of said antenna unit support on said vehicle and comprising a latch means and a latch means support; said latch means support firmly attached to said vehicle and said latch means movably supported on said latch means support, said latch means being movable between (i) one position wherein it engages said latch engaging means while said rectilinear electrically conductive element is vertical and (ii) another position wherein said latch means does not engage said latch engaging means while said rectilinear electrically conductive element is in a nonvertical position spring means attached to said latch means and holding said latch means into engagement with said latch engagement means when said latch means is at said position wherein it engages said latch engaging means.

2. Apparatus as in claim 1 wherein said shell of said antenna unit extends above said loading coil and said one, upper, end of said tension bearing support is attached to the shell of said antenna above said loading coil.

3. Apparatus as in claim 2 comprising a motor and a crank and wherein said tension bearing support is a flexible cable, said motor mounted on said vehicle between said pivotal antenna unit support means and said overload release means, and a motor control means for said motor is operatively connected to said motor and located within said vehicle;

said crank comprising a first crank arm extending parallel to the length of said vehicle and a second arm extending transverse thereto, said second arm connected to and driven by said motor and connected to a first end of said first crank arm, said first crank arm having a second end spaced from its first end, said second end comprising said latch engaging means and said first crank arm connected to said lower end of said tension bearing support between the ends of said first crank arm.

4. Combination as in claim 1 wherein said antenna unit comprises a rigid non-magnetic electrically non-conductive shell firmly attached to and surrounding said antenna element and loading coil, said shell having a width of 4 to 12 inches and a thickness of 2 to 4 inches, said shell extending from the bottom of said antenna unit to within 4 inches of the top thereof.

5. System as in claim 1 comprising a motor and cable control arm assembly, a motor and cable control arm assembly supported on said vehicle with control means for said motor in a cab of said vehicle and operatively attached to said motor, said motor cable control arm assembly comprising a movable control arm one end of which is attached to said tension bearing support, said motor is attached to another end of said control arm to move said control arm said latching and overload assembly means engaging and releasing said one end of said control arm and comprising a longitudinally movable pawl operatively connected to means resiliently restraining longitudinal movement of said pawl, and adjustable resilient means limiting vertical movement of said pawl which is responsive to a stress limit in said tension bearing support.

* * * * *